US007305798B1

(12) United States Patent
Heierli

(10) Patent No.: US 7,305,798 B1
(45) **Date of Patent: *Dec. 11, 2007**

(54) COMPOSITE OVERFILLED ARCH SYSTEM

(75) Inventor: Werner Heierli, Zurich (CH)

(73) Assignee: Bebo of America, Montgomery, AL (US)

( * ) Notice: Subject to any disclaimer, the term of this patent is extended or adjusted under 35 U.S.C. 154(b) by 828 days.

This patent is subject to a terminal disclaimer.

(21) Appl. No.: 10/131,526

(22) Filed: Apr. 25, 2002

(51) Int. Cl.
*E04B 1/32* (2006.01)
*E01F 5/00* (2006.01)

(52) U.S. Cl. ..... 52/87; 52/86; 405/125

(58) Field of Classification Search ..... 52/87, 52/86, 263, 88–89, 169.9, 84, 169.6; 405/125, 405/124, 134, 135, 151, 150.1, 287.1; 14/24, 14/69.5
See application file for complete search history.

(56) References Cited

U.S. PATENT DOCUMENTS

| | | | | |
|---|---|---|---|---|
| 3,482,406 | A | 12/1969 | Schuppisser et al. | |
| 3,750,407 | A | 8/1973 | Heierli et al. | |
| 3,999,394 | A | 12/1976 | Eberhardt et al. | |
| 4,221,502 | A * | 9/1980 | Tanikawa | 405/126 |
| 4,458,457 | A | 7/1984 | Heierli | |
| 4,490,950 | A | 1/1985 | Heierli | |
| 4,537,529 | A * | 8/1985 | FitzSimons | 405/125 |
| 4,558,969 | A * | 12/1985 | FitzSimons | 405/124 |
| 4,587,684 | A * | 5/1986 | Miller | 14/24 |
| 4,595,314 | A | 6/1986 | Lockwood | |
| 4,642,952 | A * | 2/1987 | Prandin | 52/169.6 |
| 4,687,371 | A | 8/1987 | Lockwood | |
| 4,695,187 | A * | 9/1987 | Mikhailovsky et al. | 405/124 |
| 4,704,754 | A * | 11/1987 | Bonasso | 14/20 |
| 4,745,713 | A * | 5/1988 | Gotoh | 52/89 |
| 4,797,030 | A | 1/1989 | Lockwood | |
| 4,854,775 | A | 8/1989 | Lockwood | |
| 4,993,872 | A * | 2/1991 | Lockwood | 405/125 |
| 5,199,819 | A * | 4/1993 | Matiere | 405/149 |
| 5,281,053 | A * | 1/1994 | Matiere | 405/149 |
| 5,439,319 | A * | 8/1995 | Flanagan et al. | 405/152 |
| 5,836,717 | A * | 11/1998 | Bernini | 405/125 |
| D406,902 | S | 3/1999 | Lockwood | |
| 6,205,717 | B1 * | 3/2001 | Shall et al. | 52/89 |
| 6,243,994 | B1 | 6/2001 | Bernini | |
| 6,434,892 | B1 | 8/2002 | Heierli | |
| 6,854,928 | B2 | 2/2005 | Lockwood | |

FOREIGN PATENT DOCUMENTS

| | | |
|---|---|---|
| AT | 395894 B | 3/1993 |
| AT | 397981 B | 8/1994 |
| EP | 0393197 A | 10/1990 |
| JP | 07003826 A | 6/1995 |
| NL | 9300550 A | 10/1994 |

* cited by examiner

*Primary Examiner*—Carl D. Friedman
*Assistant Examiner*—Chi Q. Nguyen
(74) *Attorney, Agent, or Firm*—Thompson Hine LLP

(57) ABSTRACT

An overfilled arch bridge system includes a composite arch which has a precast layer and a cast-in-place layer. The system further includes means for reducing bending moments within the overfilled arch. The means include customizing the arch end geometry and prestressing the arch prior to or during loading. The system can be used in connection with the overfilled arch system disclosed in co-pending patent application titled "Top Arch Overfilled System" filed by the same inventor on Mar. 22, 2002.

7 Claims, 7 Drawing Sheets

Overfilled arch structure with straight side walls

Overfilled arch structure with arched sides

COMPOSITE OVERFILLED ARCH SYSTEM

TECHNICAL FIELD OF THE INVENTION

The present invention relates to the general art of structural, bridge and geotechnical engineering, and to the particular field of overfilled arch and/or cut-and-cover structures.

CROSS-REFERENCE TO RELATED APPLICATIONS

The present application incorporates by reference the disclosure of co-pending patent application titled "Top Arch Overfilled System" filed by the same inventor on Mar. 22, 2002.

BACKGROUND OF THE INVENTION

Frequently, overfilled arch structures formed of precast or cast-in-place reinforced concrete are used in the case of bridges to support one pathway over a second pathway, which can be a waterway, a traffic route, or in the case of other structures, a storage space of the like. The terms "overfilled arch" or "overfilled bridge" will be understood from the teaching of the present disclosure, and in general as used herein, an overfilled bridge or an overfilled arch is a bridge formed of arch elements that rest on the ground or on a foundation and has soil or the like resting thereon and thereabout to support and stabilize the structure and in the case of a bridge provide the surface of the second pathway. The arch form is generally arcuate such as cylindrical in circumferential shape, and in particular a prolate shape; however, other shapes can be used. Examples of overfilled bridges are disclosed in U.S. Pat. Nos. 3,482,406 and 4,458,457, the disclosures of which are incorporated herein by reference.

Presently, reinforced concrete overfilled arches are usually constructed by either casting the arch in place or placing precast elements. These arched structures rest on prepared foundations at the bottom of both sides of the arch. The fill material, at the sides of the arch (backfill material) serves to diminish the outward displacements of the structures when the structure is loaded from above. As used herein, the term "soil" is intended to refer to the normal soil, which can be "backfill" (soil brought to and placed in location) or "in situ" (soil in its original location). Such soil is not adequate to support the concentrated loads at the ends of a flat arch or conventional arch without load distribution through the use of arch footings and/or reinforced foundation blocks.

For the prior art structures, overfilled arches are normally formed such that the foundation level of the arch is at the approximate level of a lower pathway or floor surface of an underground structure over which the arch spans. Referring to FIGS. 1A-1C, it can be understood that prior art systems S1 and S2 include sides or sidewalls SW1 and SW2 which transfer loads from tops T1 and T2 of the arch to foundation F1 and F2. The sides of arch systems S1 and S2 must be sufficiently thick and contain sufficient reinforcement in order to be able to carry these loads and the thereby induced bending moments.

Furthermore, as it is necessary to limit the normal forces and bending actions in the top and sides of prior art overfilled arch systems to an acceptable level, the radius of the arch is in practice restricted. This restriction in arch radius leads to a higher "rise" R1 and R2 (vertical dimension between the top of clearance profile C1 and C2 of lower pathway surface LS1 or LS2 and crown CR1 and CR2 of the arch) in the arch profile than is often desirable for the economical and practical arrangement of the two pathways and formation of the works surrounding and covering the arch. This results in a lost height LH1 and LH2 which can be substantial in some cases.

Beams or slabs, while needing a larger thickness than arches, do not require that "rise" and, therefore, can be used for bridges accommodating a smaller height between the top of the clearance profile of the lower pathway and the top of the upper pathway. Arches, despite their economical advantage, often cannot compete with structures using beams or slabs for this reason, especially for larger spans. However, the larger thickness may result in an expensive structure whose precast elements may be difficult, unwieldy and heavy to transport to a building site. Thus, many of the advantages of this structure may be offset or vitiated.

Furthermore, as indicated in FIGS. 1A-1C, foundations F1 and F2 for the prior art overfilled arch systems must be substantial in order to carry the arch loading indicated in FIG. 1C as AL, and require additional excavation at the base of the arch (generally beneath the lower pathway) to enable their construction. As will be understood from the present disclosure, forces AL can be considered as being circumferential forces, and forces AV can be considered as being vertical forces with forces AH being considered as horizontal forces. Loading forces on the system are a combination of these forces.

For overfilled arches made of precast construction, the incorporation of the required height of the sides or sidewalls of the arch result either in a tall-standing precast element which is difficult and unwieldy to transport and to place and/or in the requirement of pedestals, such as pedestals F1*a* shown in FIG. 1A.

As discussed above, transportation and handling of precast arch elements of some arch structures are difficult. However, precast elements have certain advantages including the ability to support their own self-weight and all of the advantages associated with pre-casting of such structural elements. However, precast elements also have certain disadvantages, including the transportation issues mentioned above.

Therefore, it would be helpful to retain as many of the advantages associated with precast structural elements as possible while eliminating, or at least substantially reducing, as many of the disadvantages associated with precast structural elements as possible.

Likewise, cast-in-place structural elements have many advantages, including the ability to be customized on site and the elimination of the transportation problems associated with precast structural elements. However, cast-in-place structural elements also have certain disadvantages, including a need for a formwork support structure, as well.

Therefore, it would be expedient to retain as many of the advantages associated with cast-in-place structural elements as possible while eliminating, or at least substantially reducing, as many of the disadvantages associated with cast-in-place structural elements as possible.

The referenced co-pending patent application discloses and teaches a means and method of forming an arch structure system that overcomes problems associated with the mechanical inadequacy of normal soil to support bridge and other structures of interest to that, and to this, invention. The advantages associated with the means and method disclosed in the referenced co-pending patent application are substantial. Therefore, it would be valuable to utilize the teaching of the referenced co-pending patent application in a manner which also realizes the advantages associated with the retention of the advantages associated with both precast and cast-in-place overfilled arch structures while reducing, or possibly eliminating, many of the disadvantages associated with such precast and cast-in-place structures.

While the advantages associated with the means and method disclosed in the referenced co-pending patent application are substantial, it would be extremely beneficial if further advantages in support could be realized.

Bending moments applied to an overfilled bridge structure are induced by the overfill and loads, such as traffic, carried by the bridge structure. These bending moments must be accommodated by the bridge structure. Prior overfilled structures counter these bending moments by increasing structural thickness, providing larger amounts of steel reinforcement and/or by increasing the size and stiffness of the arch supports. These measures may be costly and may not be as efficient as possible.

Therefore, there is a need for a means for efficiently minimizing bending moments induced in an overfilled arch structure.

The technology disclosed and taught in the referenced co-pending patent application significantly improves the efficiency of an overfilled bridge structure in accommodating such loading over prior art structures. However, it would be helpful if these load accommodating efficiency advantages could be further improved.

Overfilled arch structures, in particular overfilled flat arches, are sensitive to outward displacement of the arch ends. This outward displacement leads to increased bending moments in the arch. Prior overfilled structures counter these bending moments by increasing structural thickness, providing larger amounts of steel reinforcement and/or by increasing the size and stiffness of the arch supports. These measures may be costly and may not be as efficient as possible.

Therefore, there is a need for a means for efficiently reducing the outward displacements, and particularly the sensitivity of an overfilled arch to outward displacements, of arch footings.

The technology disclosed and taught in the referenced co-pending patent application significantly improves the efficiency of an overfilled bridge structure in preventing such footing outward displacement as compared to prior art structures. However, it would be helpful if these resistances to arch footing outward displacement are further improved.

OBJECTS OF THE INVENTION

It is a main object of the present invention to provide an overfilled arch structure which is easier to handle and transport than presently-available arch structures.

It is another object of the invention to provide overfilled arch structure elements which are easier to handle and transport than presently-available arch structure elements yet which yield as strong and stable structures as presently-available arch structures.

It is a specific object of the present invention to provide an overfilled arch structure which includes a composite section of precast and cast-in-place concrete.

It is another object of the present invention to provide an overfilled arch structure which includes a means for efficiently counteracting bending moments induced in the overfilled arch structure.

It is another object of the present invention to provide an overfilled arch structure which includes a means for efficiently reducing the sensitivity of an overfilled arch to outward displacements of arch footings.

It is another object of the present invention to provide an overfilled arch which is prestressed to induce moments herein which counteract moments induced therein by overfill and loads on the arch structure.

It is another object of the present invention to provide an overfilled arch which has an arch end that is customized to induce eccentricities between an arch thrust reaction and a centerline of the arch.

It is another object of the present invention to provide an overfilled arch has a sensitivity to outward displacement of arch footings that is reduced as compared to presently-available arches.

It is another object of the present invention to provide an overfilled arch which utilizes treated soil to create a foundation for the arch.

It is another object of the present invention to provide an overfilled arch which includes a composite section of precast concrete and cast-in-place concrete and which utilizes soil to create a foundation for the arch, a foundation that not only reduces (vertical) settlements, but also (horizontal) displacements.

It is a another object of the present invention to provide an overfilled arch which consists of a composite of precast concrete and cast-in-place concrete layers and which utilizes the technology disclosed and taught in the referenced co-pending patent application.

It is another object of the present invention to provide an overfilled arch which uses support geometry to automatically counteract the moments induced therein by overfill and loads on the arch and which utilizes the technology disclosed and taught in the referenced co-pending patent application.

It is another object of the present invention to provide an overfilled arch which uses prestressing to automatically counteract the moments induced therein by overfill and loads on the arch and which utilizes the technology disclosed and taught in the referenced co-pending patent application.

It is another object of the present invention to provide an overfilled arch which retains many of the advantages associated with precast overfilled bridge structures while eliminating, or at least substantially reducing, many of the disadvantages associated with a precast overfilled bridge structure.

It is another object of the present invention to provide an overfilled arch which retains many of the advantages associated with cast-in-place overfilled bridge structures while eliminating, or at least substantially reducing, many of the disadvantages associated with a cast-in-place overfilled bridge structure.

It is another object of the present invention to further improve the advantages realized by the technology disclosed and taught in the referenced co-pending patent application.

SUMMARY OF THE INVENTION

These, and other, objects are achieved by an overfilled bridge arch that includes both precast and cast-in-place layers. The overfilled bridge arch can also be prestressed in an efficient and effective manner, or the ends of the arch arranged in such a way, such that bending moments induced by loading are efficiently and effectively accommodated and sensitivity of the arch to arch footing outward displacement is also reduced.

The overfilled arch bridge structure embodying the present invention can be used in conjunction with the technology disclosed and taught in the referenced co-pending patent application to thereby realize additional advantages for each technology.

The composite overfilled bridge structure embodying the present invention thus realizes advantages for both precast and cast-in-place structures as well as reducing, or even eliminating, many disadvantages associated with such precast and cast-in-place arches. Additional advantages are also realized due to the composite nature of the structure of the present invention, including the ability to efficiently waterproof the structure as well as to include efficient joint seals.

The overfilled bridge and elements thereof embodying the present invention make an overfilled bridge efficient to transport, handle and erect, yet will produce a stable and efficiently waterproofed structure.

BRIEF DESCRIPTION OF THE DRAWING FIGURES

DETAILED DESCRIPTION OF THE PREFERRED EMBODIMENT OF THE INVENTION

Other objects, features and advantages of the invention will become apparent from a consideration of the following detailed description and the accompanying drawings.

Figure 1A:
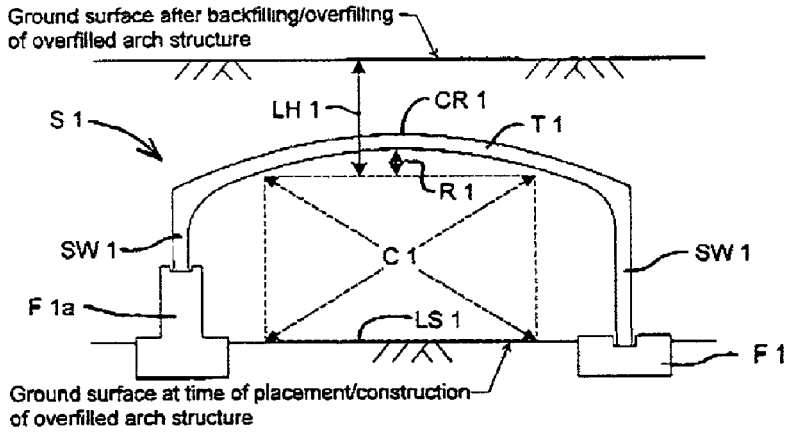
Fig 1A (Prior Art)
FIGS. 1A and 1B illustrate cross sectional views of prior art systems.
Figure 1B:
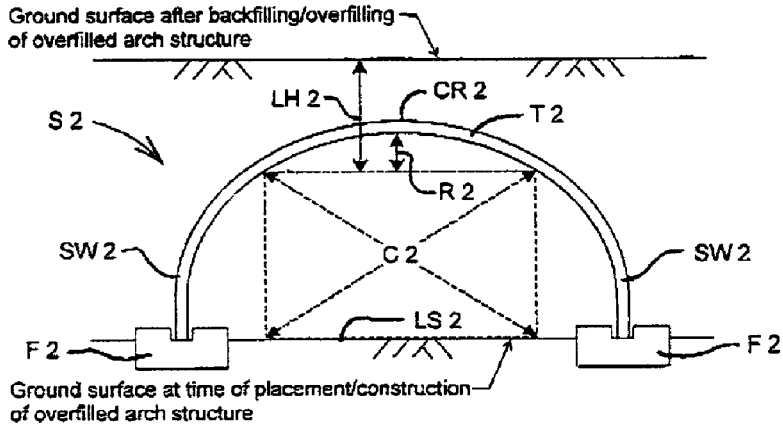
Fig 1B (Prior Art)
Figure 1C:
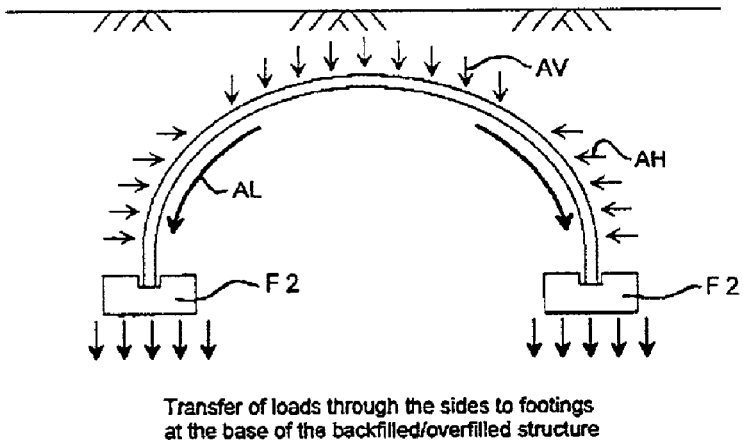
Fig 1C (Prior Art)
FIG. 1C illustrates forces associated with overfilled arches, as characteristics of a prior art system.
Figure 2:
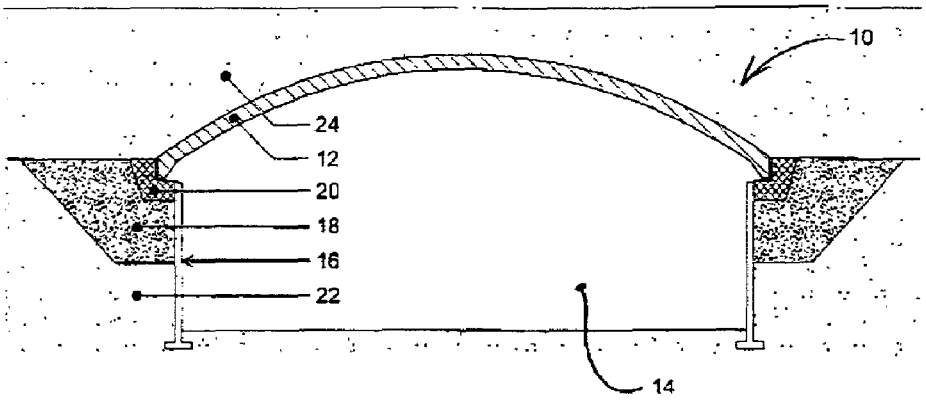
FIG. 2 shows a basic overfilled bridge structure as disclosed in the referenced patent application.

Broadly, the overfilled arch bridge structure and the elements thereof embodying the present invention can be independently used or used in conjunction with the overfilled bridge disclosed in the referenced co-pending patent application. While the present invention will be disclosed in combination with that structure, it should be understood that the present invention can be used independently of such structure and no limitation is intended by the disclosure of this invention in combination with the invention disclosed in the referenced co-pending patent application. The basic structure disclosed in the referenced patent application is shown in FIG. 2 as structure 10. As disclosed in the referenced co-pending patent application, earth overfilled arched structure 10 includes a shallow arch 12, which is concrete in the referenced patent application, spanning a clear space 14. Sides of the clear space are formed by curved or straight walls, such as wall 16, and solidified zones of earth material (backfill or in situ) bear against the springs of the arch and/or behind the walls and form foundation blocks, such as foundation block 18 which are in intimate contact via arch footings, such as footing 20, and with the springs of the arch and/or with the upper part of the sidewalls in such a way that the arched structure delivers most or all of its support forces into the foundation blocks. These, due to their size and weight, transfer and spread the support forces to the subsoil, such as subsoil 22, which can be backfill and/or in situ material, so that displacements, especially in the horizontal directions, are minimal. Overfill, such as earth overfill 24 is placed on top of arch 12. The disclosure of this structure will not be further presented, with reference to the co-pending patent application being made for such disclosure.

As discussed above, the overfilled bridge structure embodying the present invention combines precast and cast-in-place advantages and also stabilizes the arch structure.

Figure 3:
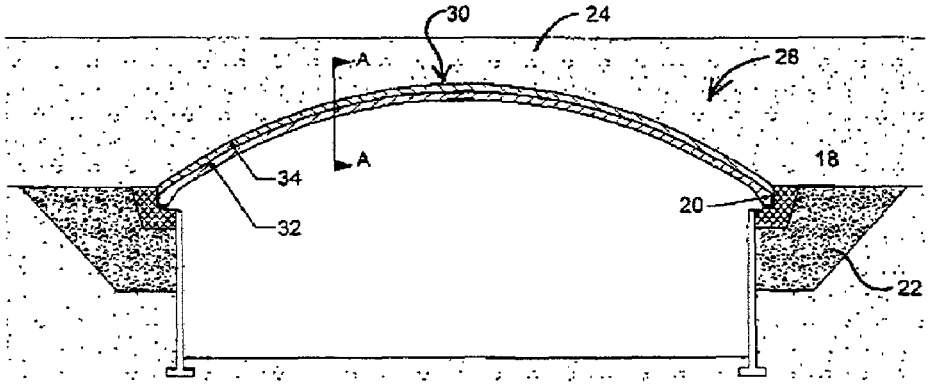
FIG. 3 is an elevational view of a composite overfilled bridge structure embodying the present invention.
Figure 4:
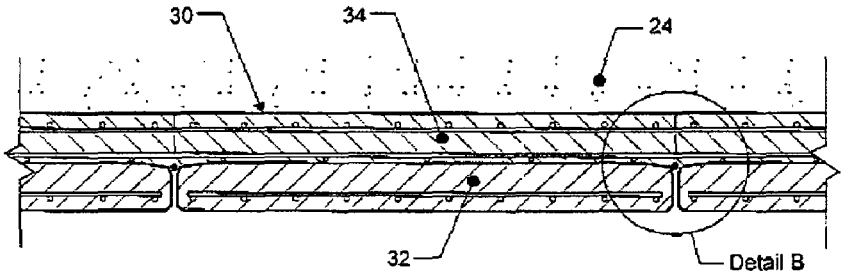
FIG. 4 is a view taken along line A-A of FIG. 3.
Figure 5:
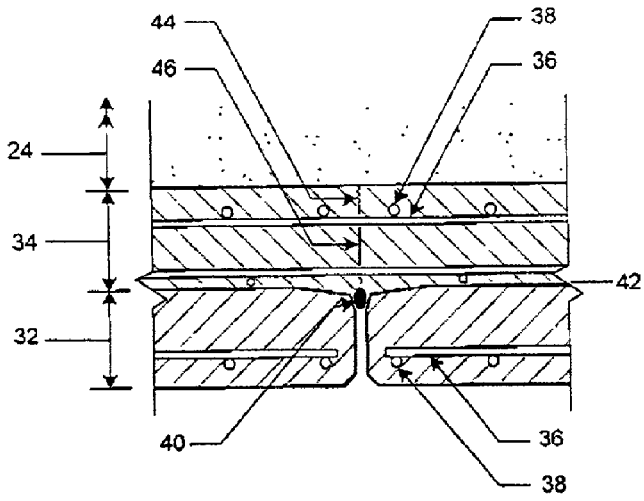
FIG. 5 shows detail B of FIG. 4.

Referring first to FIGS. 3-5, it can be seen that the present invention is embodied in an overfilled bridge structure 28 comprising an arch 30 which has a lower layer 32 which is precast and an upper layer 34 which is cast-in-place. As shown in FIG. 2, the arch layers contact footings, such as footing 18, at arch ends, such as arch end 20, when used in conjunction with the structure disclosed in the referenced patent application. Precast elements form the initial arch shape and cast-in-place concrete is poured over the precast elements to complete an overfilled arch of a shape and thickness that is similar to the shape and thickness of prior structures.

As can be understood from FIGS. 3, 4 and 5, layers 32 and 34 can be reinforced concrete with longitudinal rebars, such as rebar 36, and arch rebars, such as rebar 38, therein. Joint seals, such as joint seal 40, can be included as well and a waterproofing, such as waterproofing 42, can also be included between layers 32 and 34. Shrinkage crack inducers, such as shrinkage crack inducer 46, can also be included in cast-in-place layer 34 to induce shrinkage cracks, such as shrinkage crack 44, within the cast-in-place concrete, adjacent to the gaps between precast elements. As can be seen in FIG. 5, the thickness of the cast-in-place layer 34 may be locally increased adjacent to the gaps between precast elements, in order to increase the depth of the concrete section at this location. This has the inherent advantage of increasing the longitudinal moment carrying capacity of these locations, thereby maintaining the longitudinal load-sharing advantage of the cast-in-place previous art.

The precast layer of the arch forms the complete arc of the arch span, but is thinner, and therefore lighter to transport and handle than prior art precast arches. The precast arch elements are sized to be able to support their own self-weight during transportation and placement, as well as to be sufficiently strong to enable casting layer 34 of cast-in-place concrete over the precast layer 32. Those skilled in the art will understand how to size and form precast layer 32 based on the teaching of this disclosure. The composite section of precast and cast-in-place concrete thus formed has the thickness and strength of previous structures which are exclusively precast or exclusively cast-in-place arches.

The main advantages of the composite arch system embodying the present invention include: the weight of the transported elements is lower, and can be lower by half, than prior precast elements (or alternatively the elements can be made wider such that fewer elements need to be transported); and the cast-in-place layer 34 facilitates load sharing longitudinally along the arch to distribute concentrated loads. Furthermore, placement of waterproofing between precast elements is better facilitated than in prior structures. Thus, the composite system embodying the present invention has advantages over either a fully precast arch. No formwork or formwork support structure is required to form the arch embodying the present invention. The elimination of formwork or formwork support structures will result in considerable saving in costs associated with the formwork, and the clearance below the arch will not be reduced during construction since a temporary support structure is not required. Thus, the structure embodying the present invention also has advantages over cast-in-place arches.

As also mentioned above, the overfilled bridge structure of the present invention includes means for reducing the bending moments within the overfilled arches, as well as reduces the arch's sensitivity to any outward displacement of the arch footings. Reducing the bending moments also reduces the structural depth and steel reinforcement required with the advantages concomitant to such reduction.

Broadly, the means include either customized arch end geometry or prestressed arches, with the prestressing occurring either prior to or during loading.

Figure 6:
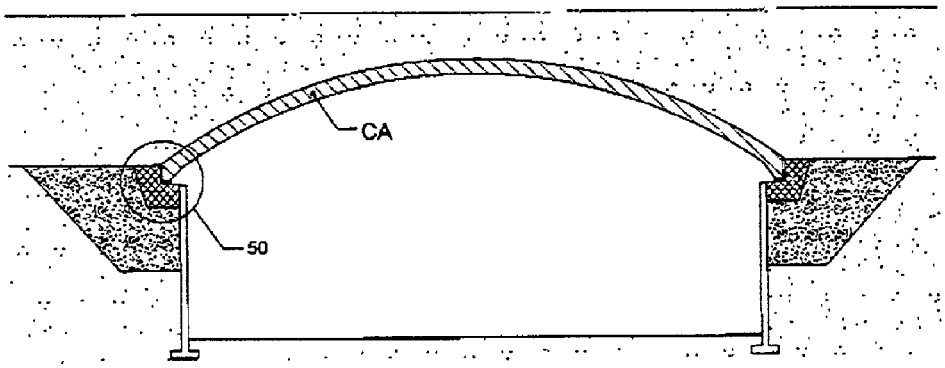
FIG. 6 is an elevational view of an overfilled arched bridge structure of the present invention illustrating arch footing elements.
Figure 7:
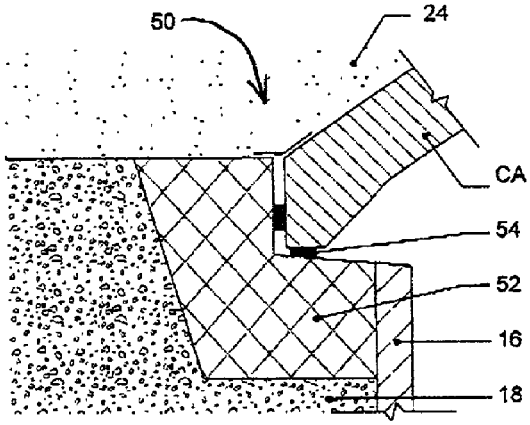
FIG. 7 is a detail view of one form of a bearing forming an arch spring to arch footing interface.

Referring to FIGS. 6 and 7, a basic arch footing 50 of a concrete arch CA is shown as including a cast-in-place arch footing 2 located between arch CA and wall 16 and foundation block 18. A bearing 54 is interposed between the arch spring and the arch footing. Overfill 24 is positioned above the arch CA.

The structure embodying the present invention improves over the basic arch footing shown in FIGS. 6 and 7. The structure of the present invention includes two main means by which the bending moments and thus the structural depth and steel reinforcement are reduced. The means embodying the present invention include a customized arch end geometry (FIGS. 10, 11 and 12) and prestressing the arch prior to or during loading (FIGS. 13, and 15-18).

Figure 8:
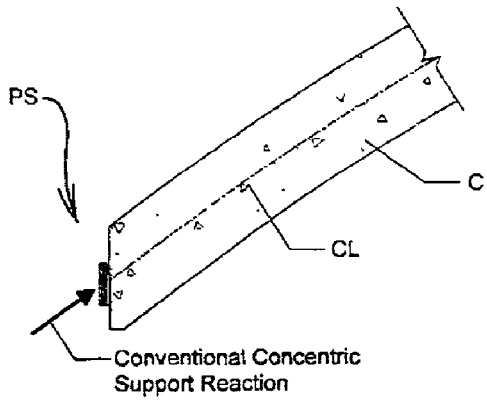
Fig 8 (Prior Art)
FIG. 8 shows a concentric support reaction of the prior art.
Figure 9:
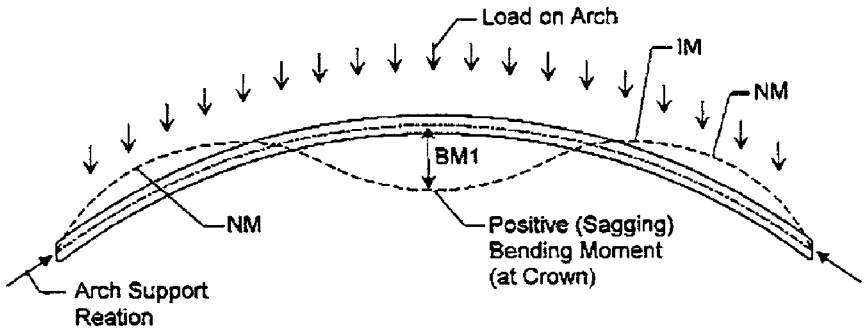
Fig 9 (Prior Art)
FIG. 9 is a diagram illustrating moment distribution in an arch for a conventional arch support such as shown in FIG. 8.

Referring to FIGS. 8 and 9, a prior art arch support PS is shown in conjunction with an arch C having a centerline CL. As shown in FIG. 8, arch support PS is located to provide arch support reaction at centerline CL. The resulting moment distribution is indicated in FIG. 9 by dotted line IM and in which negative bending moments NM are defined adjacent to the shoulders of the arch and a positive (sagging) bending moment BM1 is defined at the crown of the arch.

Figure 10:
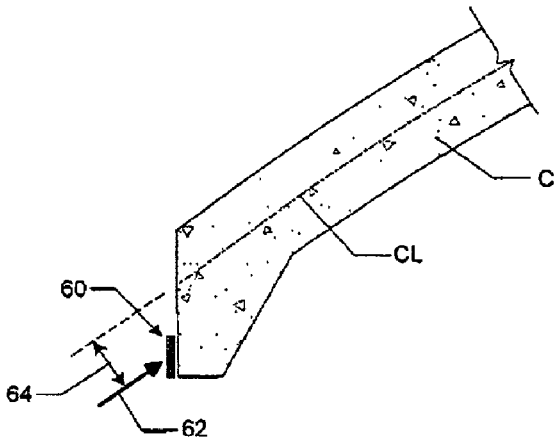
FIG. 10 shows an eccentric arch support reaction according to the teaching of the present invention.
Figure 11:
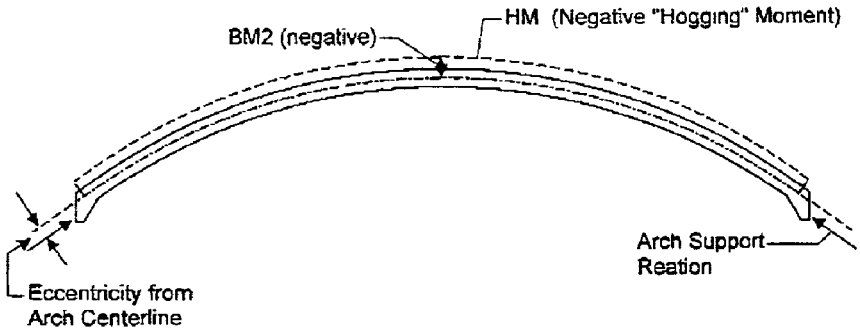
FIG. 11 is a diagram illustrating the moment induced by support reaction eccentricity.

The means embodying the present invention is illustrated in FIG. 10 includes an eccentric arch support 60. As shown in FIG. 10, eccentric arch support 60 is located to create arch support reaction 62 spaced apart from centerline CL of arch C, with the eccentric being indicated in FIG. 10 by reference number 64. The moment induced by support reaction eccentricity is indicated in dotted line HM shown in FIG. 11. As can be understood from FIG. 11, the reaction due to the reaction eccentricity induces a constant negative "hogging" moment BM2 in the arch.

Figure 12:
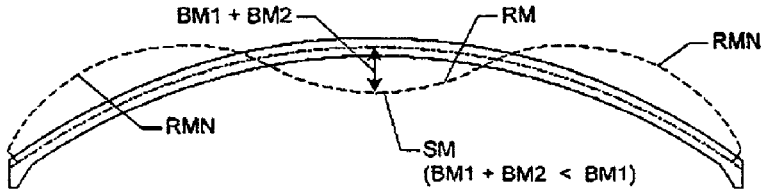
FIG. 12 is a diagram illustrating the resultant moment distribution for a customized end geometry such as shown in FIG. 10.

Referring next to FIG. 12, it can be understood that adding the constant negative moment BM2 to the negative/positive moment shown in FIG. 9 for moment distribution in the arch yields a resultant moment distribution RM shown as a dotted line in FIG. 12. As can be understood from FIG. 12, resultant moment distribution RM has increased negative bending moments RMN located near the shoulders and a decreased positive (sagging) bending moment SM near the crown. Bending moment SM is a moment addition of bending moments BM1+BM2, with the total of (BM1+BM2) being less than BM1 due to the signs of the bending moments. This can also be visualized using the absolute value of the total of (BM1+BM2). Thus, the peak positive moments in the arch crown are reduced over the prior art (non-eccentric) form of arch support.

Prestressing can also be used to reduce the bending moments within an earth overfilled arch. Prestressing is illustrated in FIGS. 13-18. As shown in FIG. 14, loading L on an arch will induce a bending moment IM' which, as discussed in relation to FIG. 9, includes negative bending moments NM' at the shoulders and a positive (sagging) bending moment BM1' at the crown. FIG. 14 is similar to FIG. 9, but is included here to better explain the prestressing embodiment of the present invention.

Figure 13:
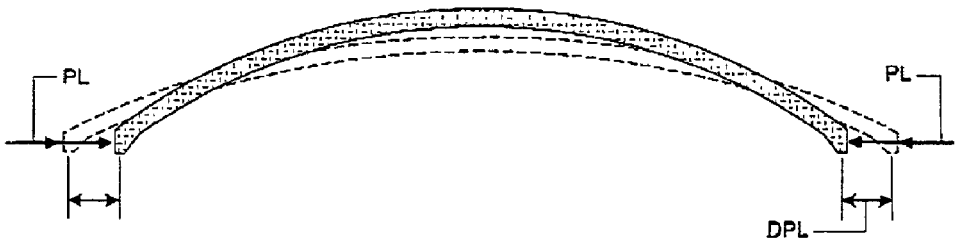
FIG. 13 is a diagram illustrating moment optimization obtained by prestressing an arch.
Figure 14:
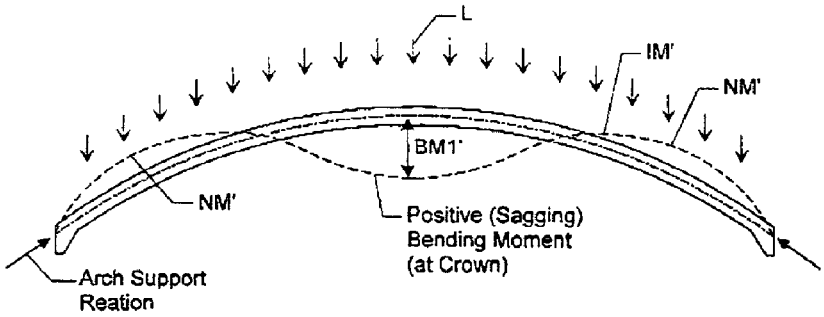
Fig 14 (Prior Art)
FIG. 14 is a diagram illustrating moment distribution in an arch for a prior art arch support.
Figure 15:
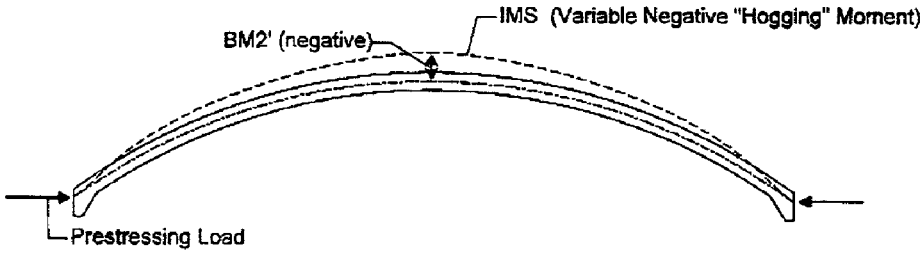
FIG. 15 is a diagram illustrating moment induced by prestressing load placed on an arch.

As shown in FIG. 13, prestressing loads PL are applied to an arch to displace the arch by a distance DPL prior to or during loading of the arch. FIG. 15 illustrates the moment IMS induced in the arch as a result of prestressing load PL. As shown in FIG. 15, induced bending moment IMS is a variable negative "hoggin" moment which has a negative portion BM2' near the crown of the arch. During prestressing, a (hogging) moment is induced and then is locked into the arch. This moment is opposite to the peak (sagging) moment in the crown of a conventionally supported arch.

Figure 16:
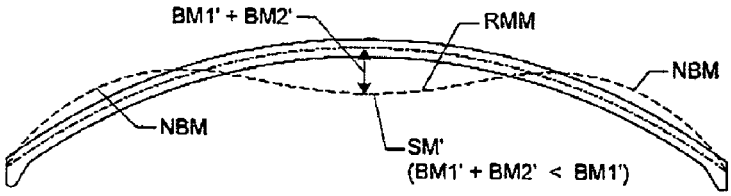
FIG. 16 is a diagram illustrating a resultant moment distribution for a prestressed arch.

FIG. 16 illustrates the arch bending moment RMN which results by adding bending moment IMS associated with prestressing to bending moment IM' associated with the arch support. As above, as a result of the signs of the bending moments, bending moment RMM includes a negative bending moment NBM at the shoulders of the arch which is greater than the negative moments NM' at the shoulders but a reduced positive (sagging) bending moment SM' at the crown of the arch. As discussed above, due to the signs of the moments, the total of (BM1'+BM2') is less than BM1'. Prestressing the arch also reduces the sensitivity of the arch to outward displacement of the arch footings.

Figure 17:
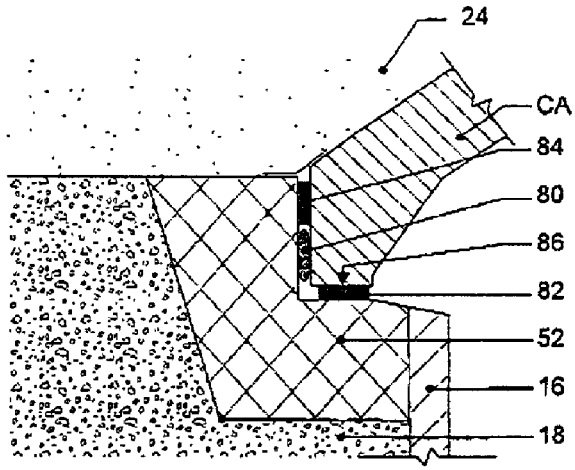
FIG. 17 is a detail view from FIG. 6 of a bearing interposed between an arch spring and an arch footing in which the arch will be prestressed.

FIG. 17 illustrates one means for prestressing the arch. As shown in FIG. 17, an element 80 is interposed between the arch footing and the arch. Element 80 prestresses the arch as discussed above. One form of element 80 includes an inflatable element, such as a hose or other means. Such hose may be inflated and pressurized with a setting substance such that compression is induced and locked into the arch. As shown in FIG. 17, bearing 82 is an arch spring to arch footing interface and has a low friction interface 86 between the arch and bearing 82. The arch can be the arch as discussed in the reference patent application or the composite arch disclosed herein. As will be understood from the teaching of the present disclosure, the arch end arrangement shown in FIG. 10 could be applied to both arch ends such that the arch can be prestress from both ends.

Figure 18:
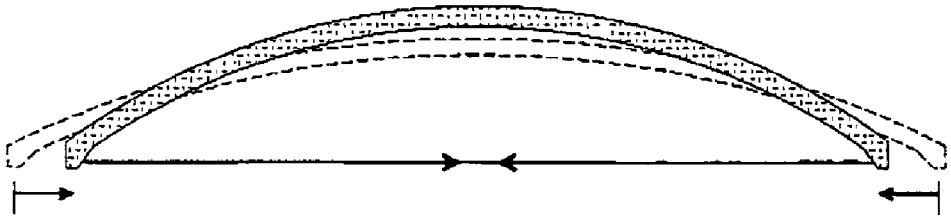
FIG. 18 is a diagram illustrating use of a tie in order to prestress the arch.

FIG. 18 illustrates another means of prestressing the arch whereby a tie (or ties) is attached to each end of the arch, and tensioned in order to compress the arch (analogous to the string on a bow used for launching arrows in archery).

It is understood that while certain forms of the present invention have been illustrated and described herein, it is not to be limited to the specific forms or arrangements of parts described and shown.

What is claimed is:

1. An overfilled arch structure comprising:

overfill material;

a void area formed in the overfill material, the void area having a lower pathway surface, first and second generally vertical sidewalls extending upward from the lower pathway surface, the first and second sidewalls spaced apart by the lower pathway surface; and an arch spanning the void area, a first end of the arch extending over, and outward beyond the first sidewall and positioned in a non-contacting relationship relative to the first sidewall, the second end of the arch extending over, and outward beyond the second sidewall and positioned in a non-contacting relationship relative to the second sidewall, the arch includes a first arch-shaped layer of precast concrete having a lower surface exposed to the lower pathway surface and a second arch-shaped layer of cast-in-place concrete contiguous with upper surface of the first layer across substantially an entirety of a span of the arch.

2. The overfilled arch structure defined in claim 1 further including reinforcing elements in said first layer and in said second layer.

3. The overfilled arch structure defined in claim 1 further including joints in said first layer, where the second layer is continuous over said joints.

4. The overfilled arch structure defined in claim 1 wherein the first end of the arch is supported by a first concrete footer located near the top of the first sidewall, and the second end of the arch rests on a second concrete footer located near the top of the second sidewall.

5. The overfilled arch structure of claim 4 wherein a lower edge of the first arch footing is spaced higher than the lower pathway surface and a lower edge of the second arch footing is spaced higher than the lower pathway surface.

6. The overfilled arch structure defined in claim 1 further including waterproofing.

7. An overfilled arch structure comprising:

overfill material;

a void area formed in the overfill material, the void area having a lower pathway surface, first and second sidewalls extending upward from the lower pathway surface, the first and second sidewalls spaced apart by the lower pathway surface;

an arch spanning the void area, a first end of the arch extending over, and outward beyond the first sidewall and positioned in a non-contacting relationship relative to the first sidewall, the second end of the arch extending over, and outward beyond the second sidewall and positioned in a non-contacting relationship relative to the second sidewall, the arch includes a first arch-shaped layer of precast concrete having a lower surface exposed to the lower pathway surface and a second arch-shaped layer of cast-in-place concrete contiguous with an upper surface of the first layer across substantially an entirety of a span of the arch;

wherein the first end of the arch is supported by a first concrete footer located near the top of the first sidewall, and the second end of the arch rests on a second concrete footer located near the top of the second sidewall;

wherein a lower edge of the first arch footing is spaced higher than the lower pathway surface and a lower edge of the second arch footing is spaced higher than the lower pathway surface; and wherein at least one prestressing element is positioned between the first end of the arch and the first concrete footer and at least one other prestressing element is located between the second end of the arch and the second concrete footer.

* * * * *